US007540072B2

(12) United States Patent
Anzini et al.

(10) Patent No.: US 7,540,072 B2
(45) Date of Patent: Jun. 2, 2009

(54) ZIPPER CONSTRUCTION FOR ENHANCED SEALING

(75) Inventors: David J. Anzini, Middletown, NY (US); Charles G. Greco, Bardonia, NY (US); Rusty Koenigkramer, Nanuet, NY (US); Glyn Russell, New City, NY (US); Lawrence Share, Skokie, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/474,619

(22) Filed: Jun. 26, 2006

(65) Prior Publication Data

US 2007/0294866 A1 Dec. 27, 2007

(51) Int. Cl.
*A44B 19/10* (2006.01)
*A44B 19/16* (2006.01)
*B65D 33/16* (2006.01)

(52) U.S. Cl. ..... 24/399; 24/585.12; 24/DIG. 50

(58) Field of Classification Search ..... 24/399, 24/400, 585.1, 585.12, DIG. 50; 383/63, 383/64

See application file for complete search history.

(56) References Cited

U.S. PATENT DOCUMENTS

| | | | | | |
|---|---|---|---|---|---|
| 5,067,822 | A * | 11/1991 | Wirth et al. | 383/61.2 |
| 5,209,574 | A * | 5/1993 | Tilman | 383/63 |
| 5,638,586 | A * | 6/1997 | Malin et al. | 24/585.12 |
| 5,655,273 | A * | 8/1997 | Tomic et al. | 24/584.1 |
| 5,664,303 | A * | 9/1997 | Johnson | 24/585.12 |
| 5,747,126 | A * | 5/1998 | Van Erden et al. | 428/35.2 |
| 6,154,934 | A * | 12/2000 | Matthews | 24/585.1 |
| 7,036,988 | B2 * | 5/2006 | Olechowski | 383/210.1 |
| 7,216,405 | B2 * | 5/2007 | Gradl | 24/585.12 |
| 2007/0206888 | A1 * | 9/2007 | Chang | 383/200 |

FOREIGN PATENT DOCUMENTS

| | | |
|---|---|---|
| EP | 1 579 780 | 9/2005 |
| WO | WO 2006/090693 | 8/2006 |

* cited by examiner

*Primary Examiner*—Robert J Sandy
(74) *Attorney, Agent, or Firm*—Day Pitney LLP

(57) ABSTRACT

The use of coextruded or integral sealing ribs on zipper flanges enhances the quality of the sealing between the flanges and the walls of a reclosable package. The coextruded sealing ribs may be made from sealing resins or similar materials. Additionally, grip strips are placed on the opposite side of the flanges from the ribs in order to improve the quality of the sealing even further and to inhibit inner flange sealing.

23 Claims, 2 Drawing Sheets

ZIPPER CONSTRUCTION FOR ENHANCED SEALING

BACKGROUND OF THE INVENTION

1. Field of the Invention

The present invention relates to the use of coextruded sealing ribs on zipper flanges to enhance the quality of the sealing between the flanges and the walls of a reclosable package. The present invention further relates to placing grip strips on the opposite side of the flanges from the ribs in order to improve the quality of the sealing even further.

2. Description of the Prior Art

Most currently manufactured flexible packaging is constructed from films including polypropylene. However, the application or sealing of reclosable zippers to polypropylene has been problematic at best. In general, polypropylene is minimally compatible with the polyethylene-based sealant materials that are typically found on a reclosable zipper. The resulting bond strengths between the polyethylene flange and the polypropylene film are typically not as strong as can be expected in polyethylene laminate packaging, and the temperatures required to form these weak bonds are very near to the temperatures which induce distortions in the film.

While forming zippers from polypropylene can result in stronger bonding between the zipper flanges and the film, these zippers are typically stiff and less flexible than polyethylene zippers, and therefore not as desirable.

Moreover, in thick film, gusseted, transverse direction package constructions, the zipper is prone to inner flange sealing due to the small sealing window of this zipper film combination. Similarly, when the slider zipper is notched, zipper transport can be problematic as the notches create sections of zipper that are more prone to deformation due to drag or tension transients.

OBJECTS AND SUMMARY OF THE INVENTION

It is therefore an object of the present invention to improve the bonding between polyethylene zipper components, such as flanges, and polypropylene web or film in the field of reclosable packages.

It is therefore a further object of the present invention to improve the stiffness of zippers, particularly notched zippers, in order to improve the reliability of the transport of these zippers.

These and other objects are attained by providing a flanged zipper with coextruded ribs on the sealing surfaces of the flanges. The ribs can be a continuous extrusion with the same material in a thin layer extruded in the space between the ribs, or the ribs can be discrete and separate from each other on the zipper flange. The ribs act as points of pressure concentration that enhance the sealing characteristics of the zipper flange to the film or substrate. Additionally, the addition of extruded grip strips on the zipper flange directly opposite the ribs further enhances the pressure concentration.

This configuration improves the heat transfer to the sealing surface of the zipper flange, improves the stiffness of the zipper flanges and improves the temperature difference between the onset of sealing initiation and the onset of inner flange sealing.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENTS

Figure 1:
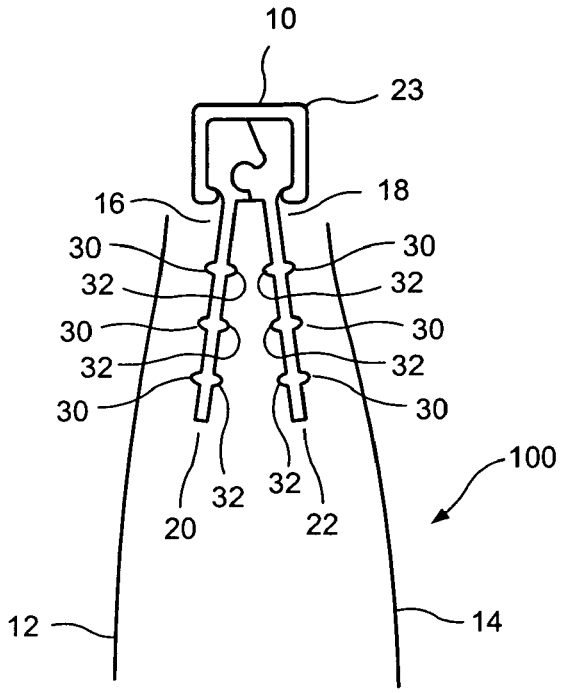
FIG. 1 is a cross-sectional, partially exploded view, of a flanged zipper of the present invention, including the sealing ribs.

Referring now to the drawings in detail wherein like numerals refer to like elements throughout the several views, one sees that FIG. 1 is a cross-sectional, partially exploded view of flanged zipper 10 within the first and second walls 12, 14 of reclosable package 100. First and second walls 12, 14 are typically formed of polypropylene. Flanged zipper 10, typically formed from polyethylene includes first and second interlocking profiles 16, 18 with respective first and second flanges 20, 22. The exterior surfaces of first and second flanges 20, 22 are sealed to the interior surface of respective first and second walls 12, 14, as is well known to those skilled in the art. Slider 23 operates in a conventional manner to separate first and second interlocking profiles if moved in a first direction and interlocking first and second interlocking profiles 16, 18 if moved in a second direction.

While flanged slider zippers are disclosed, this invention is likewise applicable to other styles of zippers, such as press-to-close or webless.

The exterior surfaces of first and second flanges 20, 22 include ribs 30. Ribs 30 are typically coextruded in the formation of first and second flanges 20, 22 and are formed parallel to each other through the length of flanged zipper 10. The interior surfaces of first and second flanges 20, 22 include grip strips 32, preferably positioned immediately opposite the ribs 30, and likewise formed parallel to each other through the length of zipper 10.

Figure 2:
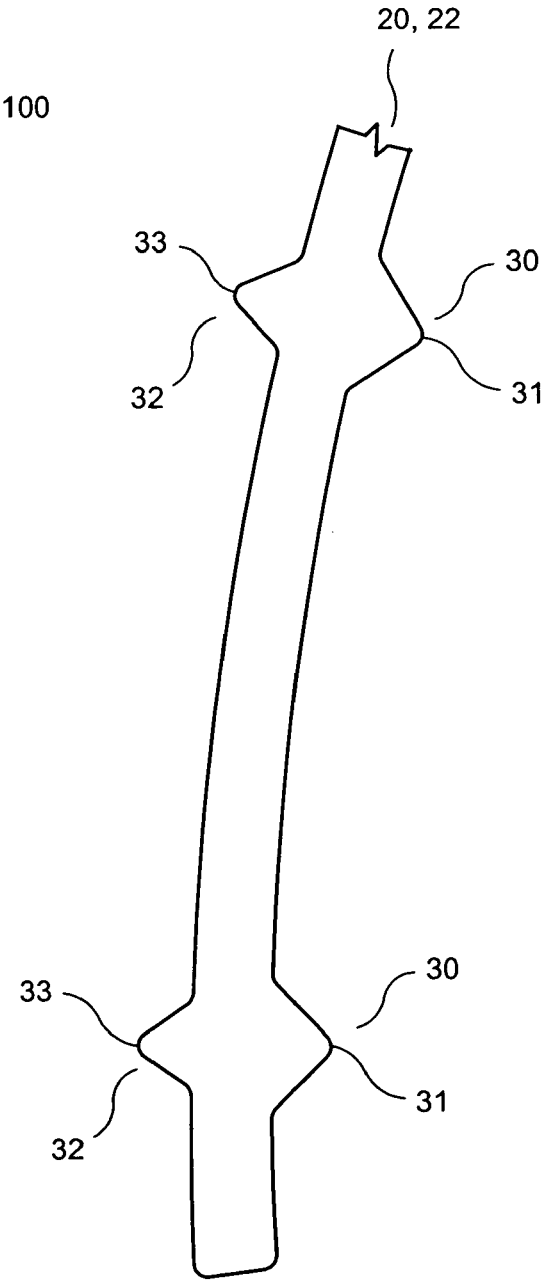
FIG. 2 is a cross-sectional view of a first embodiment of the sealing ribs opposite the grip strips on a zipper flange.

As shown in FIG. 2, this positioning increases the thickness of the structure between the apex 31 of rib 30 and the apex 33 of grip strip 32. This increase in thickness results in further increased pressure between the apex 31 of rib 30 and the first or second walls 12, 14 thereby resulting in an increased quality of seal.

Figure 3:
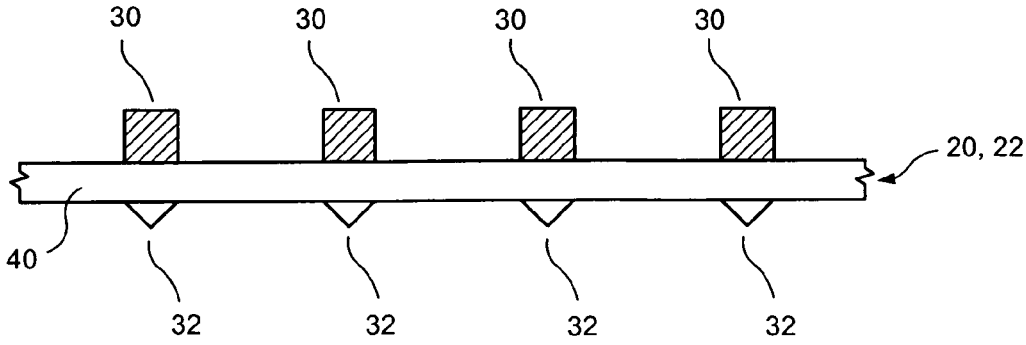
FIG. 3 is a cross-sectional view of a second embodiment of the sealing ribs, wherein the ribs are formed discretely on the flange.
Figure 4:
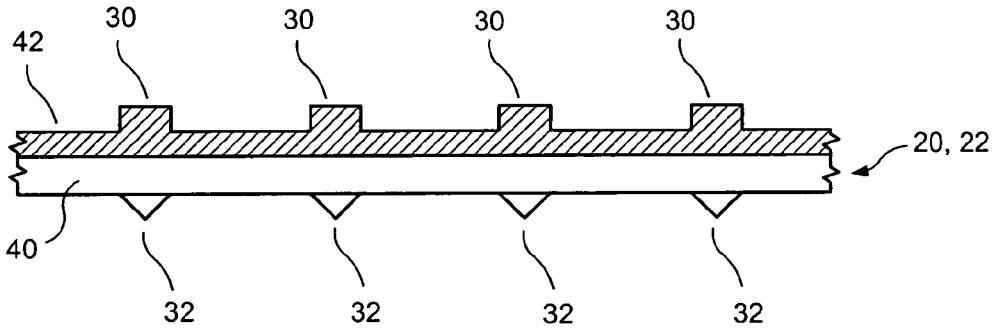
FIG. 4 is a cross-sectional view of a third embodiment of the sealing ribs, wherein the ribs are coextruded and formed as a separate layer of material from the underlying flange.
Figure 5:
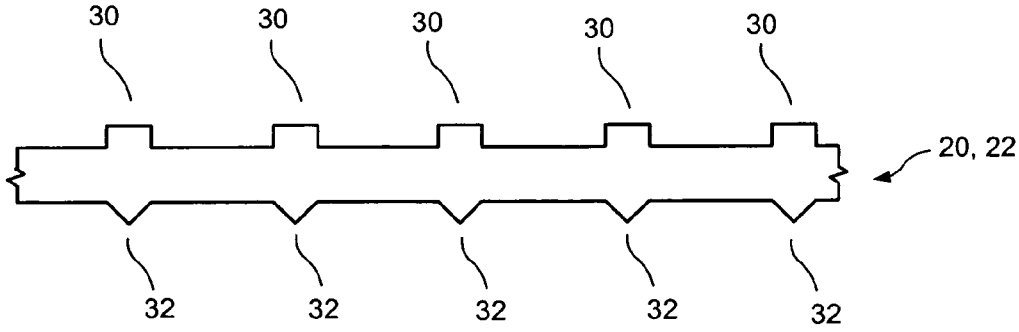
FIG. 5 is a cross-sectional view of a fourth embodiment of the sealing ribs, wherein the ribs and the flange are formed or extruded as a single layer of material.

FIGS. 3, 4 and 5 show different configurations for the formation of the ribs 30. FIG. 3 shows ribs 30 formed as discrete from each other and coextruded with the base flange resin layer 40 forming the flanges 20, 22. FIG. 4 shows ribs 30 formed from a common layer 42 coextruded with the base flange resin layer 40 forming the flanges 20, 22. FIG. 5 shows ribs 30 and flanges 20, 22 formed as a single integral layer.

Ribs 30 may be formed of any of many different cross sections, including, but not limited to triangles, squares, rectangles and trapezoids.

In FIGS. 3 and 4, ribs 30 are typically formed of materials with a lower melting point than that of flanges 20, 22, thereby lowering the effective seal initial temperature of the zipper assembly due to the enhanced heat transfer into the smaller mass of ribs 30. The material used for ribs 30 can include typical sealant layer resins, such as EVA resins; metallocene catalyzed resins; plastomers; very low density polyethylenes;

or terpolymers of ethylene, propylene and a third component, but is not limited thereto. Further, sealant resins can be applied between the ribs 30 to further enhance the sealing.

This enhanced sealing due to ribs 30 is particularly beneficial with difficult substrates, such as when the package walls 12, 14 are made from polypropylene.

Improved sealing qualities are also achieved when ribs 30 are made from the same material as the flanges 20, 22 as shown in FIG. 5. This is important in such applications as retort applications, where zipper are produced from the same materials as the package film, and no sealant layers are coextruded onto the zippers.

The size and spacing of the ribs 30 on zipper 10 has an optimum range of flange coverage in the area that the seal bar touches. Typically, the ribs should cover between fifteen and fifty percent of the flange area that will be under the heat sealing operation. In this way, the effect of pressure over this area is multiplied by the fraction of the surface area covered by the ribs. Typically, if the surface area covered by ribs is less than fifteen percent of the flange area under the sealing operation, there is not enough sealant to create a satisfactory bond to the film. Conversely, typically, if the ribs cover over fifty percent of the flange area under the sealing operation includes ribs, then the effect of pressure concentration is reduced.

The lowering of the seal initiation temperature described above effectively improves the temperature differential between the point that the slider zipper is adhered to the film substrate and the point where the inside surfaces of the zipper flanges will seal to themselves, due to the amount of heat required to attach the zipper to the package walls. The creation of a larger temperature differential on a slider zipper is especially important in transverse bag or package applications with thick films, metallized films, gusseted constructions, and combinations thereof.

Moreover, grip strips 32 opposite ribs 30 on flanges 20, 22 improve the resistance to inner flange sealing as heat transfer is minimized when the grip strips 32 of opposing flanges 12, 14 come into contact with each other. This can be further enhanced by coextruding grip strip 32 with a melting point which is higher than that of the base flange resin.

Additionally, ribs 30 increase the stiffness or modulus of the flanges 20, 22 of flanged zipper 10, aiding in the transport of the flanged zipper 10 during manufacture.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper including:

a first interlocking profile including a first flange;

a second interlocking profile including a second flange;

the first and second flanges including respective first and second exterior surfaces for sealing to respective first and second package walls, and each of the first and second exterior surfaces including a plurality of spaced apart outwardly protruding ribs for enhancing sealing with the respective first and second package walls;

the first and second flanges including respective first and second interior surfaces, the first and second interior surfaces including respective first and second pluralities of inwardly protruding strips, wherein the first plurality of inwardly protruding strips abuts the second plurality of inwardly protruding strips during sealing of the first and second exterior surfaces to the respective first and second package walls and wherein the first and second pluralities of inwardly protruding strips improve resistance to the first and second interior surfaces sealing to each other during sealing of the first and second exterior surfaces to the respective first and second package walls; and wherein the ribs and the strips are formed opposite each other on the first and second flanges.

2. The zipper of claim 1 wherein the ribs are parallel to each other.

3. The zipper of claim 1 wherein the strips are parallel to each other.

4. The zipper of claim 1 wherein the first and second interlocking profiles are formed by extrusion.

5. The zipper of claim 1 wherein the first and second flanges are formed of a first material and the ribs are formed of a second material.

6. The zipper of claim 5 wherein the second material has a lower melting temperature than that of the first material.

7. The zipper of claim 6 wherein the strips are formed of a third material.

8. The zipper of claim 7 wherein the third material has a higher melting temperature than that of the first material.

9. The zipper of claim 5 wherein the ribs are formed as discrete elements of the second material.

10. The zipper of claim 5 wherein the ribs are formed from a continuous layer of the second material on a layer of the first material.

11. The zipper of claim 1 wherein the flanges, the ribs and the strips are formed by extrusion as a single integral layer.

12. The zipper of claim 1 wherein the zipper is formed from polyethylene.

13. The zipper of claim 1 wherein the ribs are formed from a sealant layer resin.

14. The zipper of claim 13 wherein the sealant layer resin is chosen from the group consisting of EVA resins; metallocene catalyzed resins; plastomers; very low density polyethylene; and terpolymers of at least ethylene and propylene.

15. The zipper of claim 1 wherein the ribs have a cross section chosen from the group consisting of triangles, squares, rectangles and trapezoids.

16. The zipper of claim 1 further including a slider to interlock the interlocking profiles when moved in a first direction and to separate the interlocking profiles when moved in a second direction.

17. The zipper of claim 1 wherein the pluralities of spaced apart outwardly protruding ribs cover between fifteen and fifty percent of the first and second exterior surfaces.

18. A zipper including:

a first interlocking profile;

a second interlocking profile;

the first and second interlocking profiles including respective first and second exterior surfaces for sealing to respective first and second package walls, and each of the first and second exterior surfaces including a plurality of spaced apart outwardly protruding ribs for enhancing sealing with the respective first and second package walls;

the first and second interlocking profiles including respective first and second interior surfaces, the first and second interior surfaces including respective first and second pluralities of inwardly protruding strips, wherein the first plurality of inwardly protruding strips abuts the second plurality of inwardly protruding strips during sealing of the first and second exterior surfaces to the respective first and second package walls and wherein the first and second pluralities of inwardly protruding strips improve resistance to the first and second interior surfaces sealing to each other during sealing of the first and second exterior surfaces to the respective first second package walls; and wherein the ribs and the strips are formed opposite each other on the first and second interlocking profiles.

19. The zipper of claim 18 further including a slider to interlock the interlocking profiles when moved in a first direction and to separate the interlocking profiles when moved in a second direction.

20. The zipper of claim 18 wherein the pluralities of spaced apart outwardly protruding ribs cover between fifteen and fifty percent of the first and second exterior surfaces.

21. A zipper including:

a first profile;

a second profile;

the first and second profiles including respective first and second primary surfaces for sealing to respective first and second package walls, and each of the first and second primary surfaces including a plurality of spaced apart outwardly protruding ribs for enhancing sealing with the respective first and second package walls;

the first and second profiles including respective first and second secondary surfaces, the first and second secondary surfaces including respective first and second pluralities of protruding strips, wherein the first plurality of protruding strips abuts the second plurality of protruding strips during sealing of the first and second primary surfaces to the respective first and second package walls and wherein the first and second pluralities of protruding strips improve resistance to the first and second secondary surfaces sealing to each other during sealing of the first and second primary surfaces to the respective first and second package walls; and wherein the ribs and the strips are formed opposite each other on the first and second profiles.

22. The zipper of claim 21 further including a slider to interlock the interlocking profiles when moved in a first direction and to separate the interlocking profiles when moved in a second direction.

23. The zipper of claim 21 wherein the pluralities of spaced apart inwardly protruding strips cover between fifteen and fifty percent of the first and second primary surfaces.

* * * * *